United States Patent [19]

Putman

[11] 3,952,535

[45] Apr. 27, 1976

[54] AUTOMATIC EXPANSION VALVE FOR REFRIGERANT

[75] Inventor: Thomas H. Putman, Pittsburgh, Pa.

[73] Assignee: White-Westinghouse Corporation, Cleveland, Ohio

[22] Filed: Oct. 3, 1974

[21] Appl. No.: 511,972

Related U.S. Application Data

[63] Continuation of Ser. No. 383,425, July 27, 1973, abandoned.

[52] U.S. Cl. ..... 62/222; 62/527; 138/45

[51] Int. Cl.[2] ..... F25B 41/04

[58] Field of Search ..... 62/222, 223, 224, 216, 62/527, 528; 137/625.28, 625.3, 625.33, 498, 501, 517, 504; 138/44, 45; 236/92 B

[56] References Cited

UNITED STATES PATENTS

| | | | |
|---|---|---|---|
| 1,786,110 | 12/1930 | Gunn | 62/222 |
| 2,289,905 | 7/1942 | Dasher | 62/527 |
| 2,481,968 | 9/1949 | Atchison | 62/222 |
| 3,010,309 | 11/1961 | Lee | 137/517 |
| 3,194,272 | 7/1965 | Kogan et al. | 137/517 |

OTHER PUBLICATIONS

Staebler, L. A. —"Theory and Use of a Capillary Tube for Liquid Refrigerant Control" —Jan. 1948—pp. 55–59.

*Primary Examiner*—William E. Wayner
*Assistant Examiner*—William E. Tapolcai, Jr.

[57] ABSTRACT

An automatic expansion valve for controlling refrigerant flow from a condenser to an evaporator in which the valve includes a deflectable member which defines a refrigerant expansion orifice with other structure within the valve, and with the flow passage arrangement in the valve body being such as to subject at least part of the opposite faces of the deflectable member to the different pressures resulting from refrigerant flow through the expansion orifice so that changes in the deflection of the deflectable member are in accordance with differential pressure across the orifice and accordingly effects changes in the effective opening of the expansion orifice.

10 Claims, 12 Drawing Figures

PRESSURE-DEFLECTION CURVES FOR BEAM-TYPE VALVE

AUTOMATIC EXPANSION VALVE FOR REFRIGERANT

CROSS REFERENCE TO RELATED APPLICATIONS

This is a continuation of application Ser. No. 383,425 filed July 27, 1973 now abandoned.

Putman and Thompson U.S. Pat. application Ser. No. 383,427 is a related application in the sense that it discloses and claims an improvement to the basic invention of this application.

BACKGROUND OF THE INVENTION

1. Field of the Invention:

The invention relates to the art of refrigerant expansion valves.

2. Description of the Prior Art:

One commonly used automatic expansion valve for controlling the flow of refrigerant between a condenser and an evaporator is called a constant pressure refrigerant expansion valve and is designed to attempt to keep a constant absolute pressure in the evaporator during operation of the system. This valve is typically operated by a preset spring force and a force derived from the feedback of the pressure from the evaporator. The valve is arranged so that with the valve set and feeding refrigerant at a given pressure, a small increase in the evaporator pressure will act to move the valve toward a closing direction, thereby restricting the refrigerant flow and limiting the evaporator pressure. When the evaporator pressure drops below the valve setting because of a decrease in load, the valve moves in an opening position to increase the refrigerant flow in an effort to raise the evaporator pressure to the particular balanced valve setting. In a number of applications of the valve, including some room air conditioners, the valve is provided with a bypass in the form of a small slot or drilled hole in the valve seat or valve pin to prevent complete valve close-off when the compressor shuts down. This is to permit refrigerant to continue to flow at a reduced rate until high and low side pressures are equalized.

While the bypass type valve provides for the equalization after several minutes, it is believed that the bypass itself contributes to a problem which occurs when an air conditioner is operated without any forced air flow over the evaporator and compressor. In such an arrangement using a constant pressure bypass type valve, and starting with the system pressures equalized, but with the fans not operating, the valve remains closed and gives a bypass feed only. If this occurs in a system using an expansion valve which also includes a relief valve, and with, say, R-22 refrigerant, the relief valve will open at say a 600–700 p.s.i. differential so that refrigerant can then flow to the compressor and load it sufficiently that the current and temperature overload means will be operated to shut the compressor down. However if the expansion valve does not include the relief valve, the condenser pressure can build up to a value of up to 200 p.s.i. over what would be desirable before the current and temperature overload of the compressor operates. It is believed that if the bypass in the expansion valve were omitted, it is likely that the high pressure problem would be avoided. However this would not permit equalization of the system after shutdown.

The valve according to the invention is considered to be preferable in that no bypass arrangement is needed for equalization, and under a fan failure condition the valve functions in a manner which does not create any problems for the air conditioning system itself.

Of the prior art patents of which applicant is aware, U.S. Pat. No. 1,786,110 is considered to be the closest in the field of refrigerant expansion valves, but differs substantially in that it in effect includes two valves, one of which functions as an on-off valve, while the other functions like a capillary tube; neither of which corresponds to the operation of the valve of applicant's invention.

Flow control devices for controlling the flow of lubricant to hydrostatic bearings and similar in structure to the valve arrangements embodying this invention are disclosed in U.S. Pat. No. 3,110,527. However, these devices are incorporated in a system where an increase in differential pressure between a source pressure and the load pressure is taught to result in a restriction of the flow, which would be directly the opposite of the result of the operation of the refrigerant expansion valve of this invention.

SUMMARY OF THE INVENTION

In accordance with the invention the refrigerant expansion valve includes a valve body having a deflectable member therein subject to deflection in accordance with differential forces applied thereto resulting from changes in the differential pressure imposed thereon, structure in the valve body spaced closely adjacent to the deflectable member to define a refrigerant expansion orifice therebetween, a liquid refrigerant supply space upstream from the expansion orifice and adapted to receive liquid refrigerant from a condenser, an expanded refrigerant space downstream from the expansion orifice and adapted to be placed in communication with a refrigerant evaporator, the deflectable member being disposed relative to the supply space and the expanded refrigerant space to subject at least part of the opposite faces of the deflectable member to the different pressures resulting from the refrigerant flow through the expansion orifice. Thus the changes in the deflection of the deflectable member are in accordance with changes in the differential pressure across the orifice, and effect changes in the effective opening of the expansion orifice.

In what is believed to be one currently preferred form, the deflectable member takes the form of a thin plate beam mounted to permit its deflection to adjust the spacing between the deflectable beam and the upstream end of a passage through which the expanded refrigerant is discharged, with the expansion orifice being defined as the generally annular orifice between the end of the nozzle and the facing beam. In this form, the opposite faces of the beam are subject to the supply pressure, except for that area of the one face of the beam which is facing the upstream end of the nozzle. In one form the beam may be supported at its opposite ends to function as a single beam while in another form, the beam may be cantilevered at one end.

In still another arrangement, which is the subject of the noted Putman-Thomson related patent application, the beam takes the form of a circular disc or diaphragm shape with a generally centered aperture concentric with facing structure which defines the expansion orifice therewith, and with the upstream face of the disc being subject to liquid refrigerant supply pressure and the downstream face being subject to the expanded refrigerant pressure.

It is emphasized that in accordance with the concept of the invention the differential pressure across the expansion device is used to control the refrigerant flow area of the device so that the quantity of flow is a function of the difference between the supply (condenser) and outlet (evaporator) pressures, rather than simply being a function of the pressure in the evaporator as is the case wih constant pressure refrigerant expansion valves.

DRAWING DESCRIPTION

DESCRIPTION OF THE PREFERRED EMBODIMENTS

Figure 1:
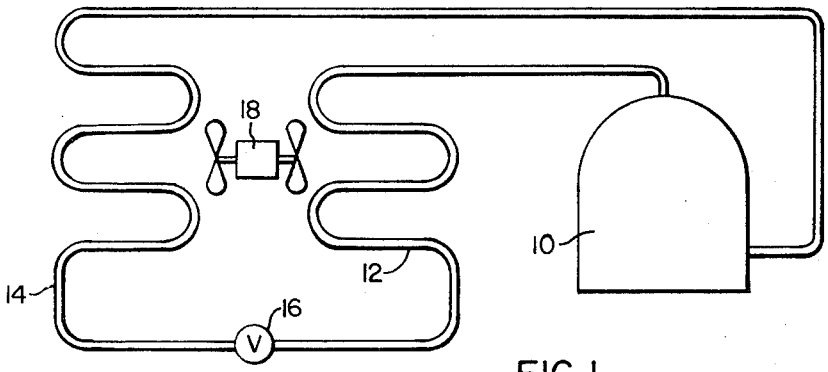
FIG. 1 is a schematic representation of an air conditioning system in which the invention may be incorporated.

At the outset it is noted that the dimensions of certain parts, and certain spacings in the drawing are exaggerated for clarity. These exaggerations include the beam thickness, the nozzle opening dimension, and the spacing between the beam and nozzle.

In FIG. 1 the schematically illustrated refrigerant system includes a compressor 10, condenser 12, evaporator 14, the connecting refrigerant lines between these components, an expansion device 16 in the line between the condenser and evaporator, and a fan-motor assembly 18 for supplying a flow of air over the condenser and evaporator as is conventional in air conditioning systems.

Figure 2:
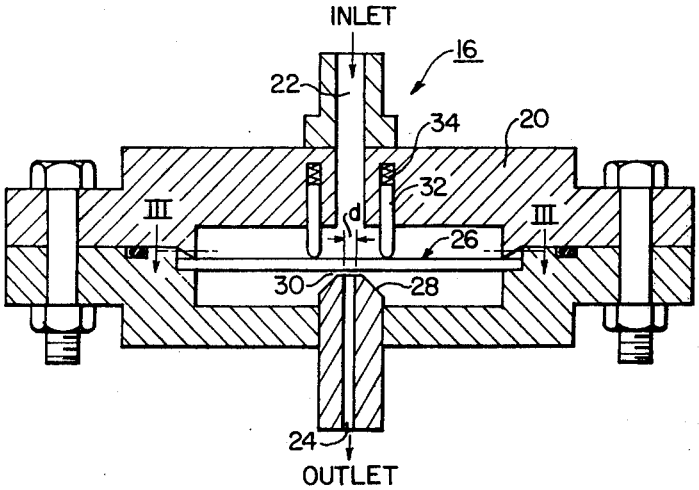
FIG. 2 is a cross sectional view of one form of refrigerant expansion valve according to the invention.
Figure 3:
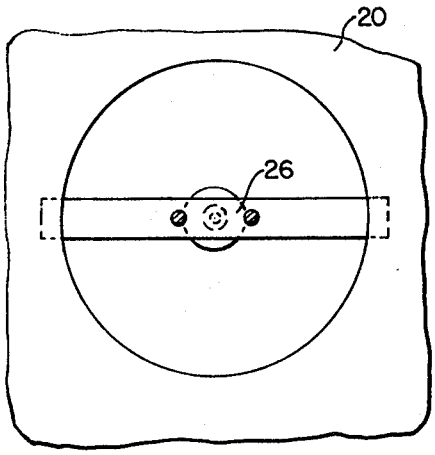
FIG. 3 is a sectional view corresponding to one taken along the line III—III of FIG. 2.

The expansion device or valve 16 of FIG. 2 includes, in accordance with the invention, a hollow valve body 20 having a liquid refrigerant inlet 22 and an expanded refrigerant outlet 24 adapted to be connected to the condenser and evaporator, respectively, and a thin plate beam 26 (FIGS. 2 and 3) supported at its opposite ends in a fashion as illustrated to simulate a free support beam and extending diametrically across the hollow interior of the valve body. The outlet passage 24 is in communication with the nozzle-shaped structure 28 inside the hollow valve body. The expansion orifice 30 of the device is of annular shape and is formed between the rim of the upstream end of the outlet passage (hereinafter called the nozzle structure 28) and the facing face of the beam 26. One of the dimensions which is exaggerated relative to other dimensions in FIG. 2 is the spacing between the end of the nozzle structure 28 and the facing beam. As is calculated hereinafter in a specific design example, the spacing between the upper end of the nozzle structure 28 and the facing beam may be in the order of 5 mils ( 0.005 inches) when the system is not operating and may have dimensions of about 3 mils at high load conditions and about 4 mils at low load conditions. This is in contrast to a diameter of the passage 24 (indicated dimensionally as "*d*" in FIG. 2), through which the expanded refrigerant flows, of about 0.110 inches. In that connection it is here noted that the effective openings of the expansion orifice should be relatively small, such as less than 30%, of the cross-sectional area of the outlet passage so that the expansion orifice area controls the expansion, rather than any significant expansion taking place in the outlet passage 24.

From the foregoing it may be seen that the valve body, beam and nozzle structure provide a flow passage arrangement in which at least a part of the opposite faces of the beam are subject to the different pressures resulting from refrigerant flow through the expansion orifice 30. That is, with the valve oriented as shown in FIG. 2, the upper face of the beam and all of the lower faces of the beam, except for that area of the lower face equivalent to the projected area of the nozzle end, are subject to the liquid refrigerant supply pressure, while the area facing the upper end of the flow nozzle is subject to the discharge pressure, which corresponds essentially with the evaporator pressure for purposes of the invention. Thus changes in the differential pressure across the expansion orifice (which corresponds substantially with the changes in the differential pressure between the condenser and evaporator, results in changes in the deflection of the beam 26 and accordingly results in changes in the effective opening of the expansion orifice 30.

In testing an early prototype of the arrangement shown in FIG. 2, and using high pressure oil instead of refrigerant, a flow instability occurred especially in one range of valve openings which apparently was based upon flow induced vibration of the beam 26. While this condition has not been observed in testing with refrigerant flow, to the extent that it could conceivably arise under certain conditions, vibration dampeners in the form of a pair of pistons 32 biased against the beam plate 26 by springs 34 may be provided as shown. In the oil test such vibration dampeners appear to adequately dampen the flow induced vibration of the beam 26 to the extent it existed.

Figure 4A:
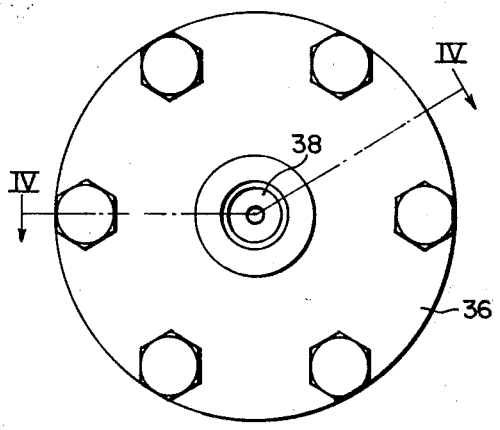
FIG. 4A is a plan view of the Putman-Thomson valve.
Figure 4:
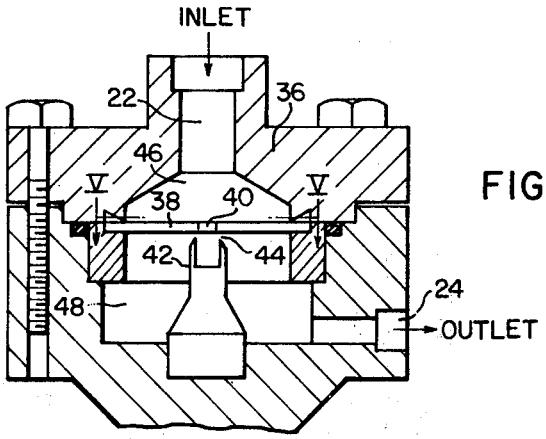
FIG. 4 is a sectional view of the Putman-Thomson form of expansion valve and corresponds to a view taken along the line IV—IV of FIG. 4A.

FIGS. 4 and 4A illustrate a device of somewhat different form from that shown in FIG. 2. A flexible member 38 in the form of a disc 38 is supported at its periphery of the valve body 36 and has a generally centered aperture 40. Also a different form of nozzle structure 42 is provided and defines the annular expansion orifice 44 with the bottom rim of the aperture 40. This arrangement is the Putman-Thomson improvement referred to hereinbefore and permits the use of a substantially thicker beam or disc and is believed to reduce the likelihood of flow induced vibrations requiring dampening. In this arrangement the space 46 on the upper side of the disc 38 is subject to supply pressure from the condenser, while the corresponding lower space 48 below the disc is subject to the expanded refrigerant pressure. The aperture 40 is large enough relative to the annular expansion orifice 44 that the expansion takes place in the orifice. Since the differential pressure is effective over virtually the total disc area, it is believed that the valve can likely be operated at higher force levels with less uncertainty (on a percentage basis) about the area the pressure differential acts upon. Additionally any potential problem from deformation of the lower part of the valve body is reduced since it is acted upon by the outlet pressure, which is substantially lower than the supply pressure. Finally, it will be appreciated that since the entire lower space 48 contains expanded refrigerant, multiple outlets from the space can be accommodated more easily than in the design of FIG. 2 where the valve is to be used for multiple evaporator circuit applications.

Figure 7:
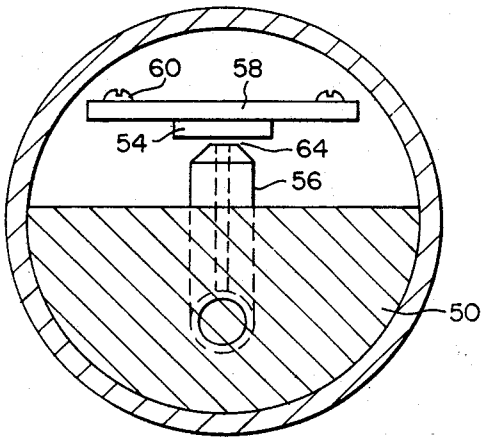
FIG. 7 is a sectional view corresponding to one taken along the line VII—VII of FIG. 6.
Figure 6:
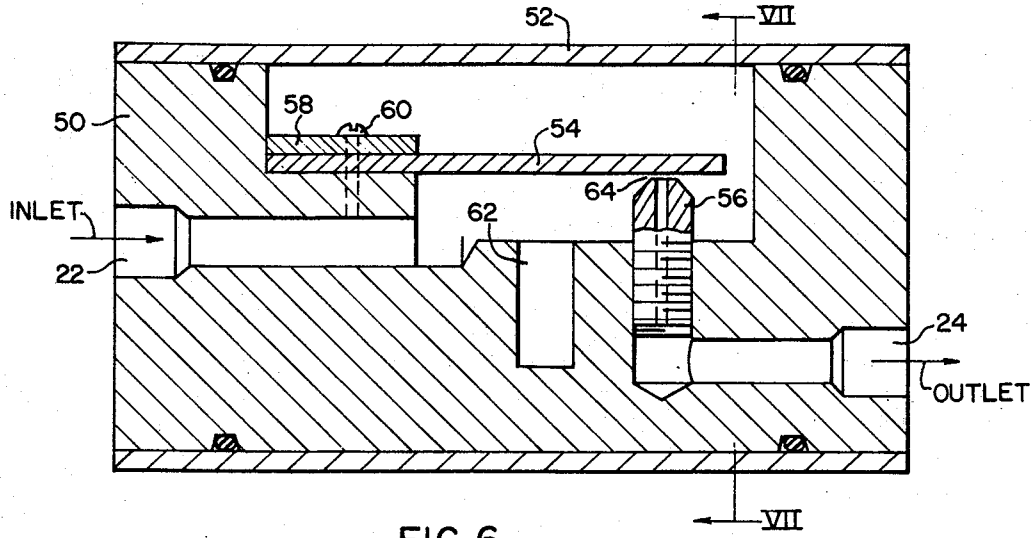
FIG. 6 is a sectional view of one form of the expansion valve in which the beam is cantilevered.
Figure 8:
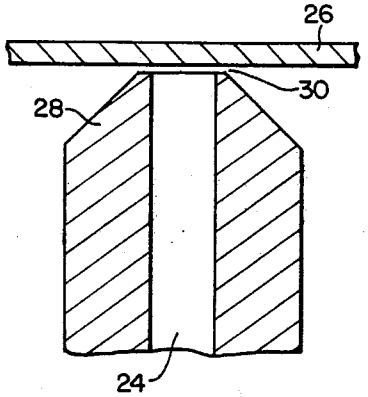
FIG. 8 is an enlarged fragmentary view illustrating the general relationship between a typical beam thickness, nozzle and opening, and spacing between the beam and nozzle.

In FIG. 6 the valve body 50 is a generally spool-shaped inner machined member with an outer sleeve 52 slipped over the body and sealing it and with the beam 54 being cantilever supported so that its deflectable end portion overlies the nozzle structure 56. The left of the beam 54 is held to the valve body by a transverse strap 58 and two machine screws 60 which are turned into the valve body. A cavity 62 for the optional installation of a vibration dampener is also provided in the valve body structure. The expansion orifice 64 is annular in shape, as is the case in FIG. 2 arrangement, and is defined between the upper end of the nozzle and the facing part of the beam 54. One advantage of the arrangement of FIGS. 6 and 7 is that the beam and nozzle structure 56 are both supported from a unitary part of the valve body so that if elastic deformation due to the pressure in the case occurs, this does not affect the spacing of the parts which control the size of the expansion orifice 64. The arrangement is also considered to be desirable from the standpoint of permitting the device to be incorporated in a relatively small overall dimension for the valve.

In the operation of the devices described, under a high load condition for an air conditioning system the pressure differential between the condenser and evaporator is greater than when the system is operated under rated conditions, or under a low load condition. Under the high load condition the greater differential pressure causes greater deflection of the beam, and accordingly results in an effective expansion orifice which is smaller than at the other conditions. The converse is of course also true in that the effective opening of the orifice is greater when the load is less, due to the lesser differential pressure.

In designing a valve to carry out the invention, the designer starts with knowledge of the desired pressure drop across the valve for, say, two of three conditions such as high load, rated load, and low load, and then can determine the required valve openings for two of the three conditions. That is, the valve is designed so that its characteristic is such that it passes through two selected points on a plot of differential pressures versus valve openings. The way in which a valve such as that illustrated in FIG. 2 is designed and calculated is described in the following.

Figure 9:
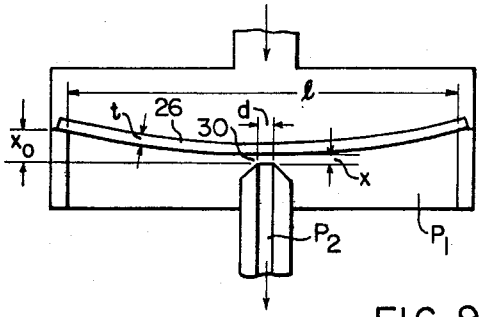
FIG. 9 is a schematic representation of the beam-type valve for reference in connection with selecting specific values in accordance with a design example.

The basic parts of the described expansion valve are the deflectable beam 26 and the expansion orifice 30 as are shown schematically in FIG. 9. The concept of using this valve as a refrigerant control device is based on the pressure and flow rate characteristics of a selected air conditioner system. The notations below are defined for the purpose of calculations which follow, and which are intended to explain an example of the underlying theory and design procedure for a particular valve.

$P_1$ = psi, inlet pressure
$P_2$ = psi, outlet pressure
$\Delta P = P_1 - P_2$ = psi, pressure drop across the valve
$x$ = in., orifice opening
$x_o$ = in., value of $x$ when $\Delta P = 0$
$d$ = in., outlet diameter
A = in.$^2$, effective orifice area
K = lb/in., beam stiffness
$l$ = in., beam length
$t$ = in., beam thickness
$b$ = in., beam width
Q = ft$^3$/sec. discharge flow rate
$C_d$ = discharge coefficient
$p$ = slug/ft$^3$, fluid density
$v$ = ft$^2$/sec, kinematic viscosity of the fluid
$f$ = lb., force on the beam
W = lb., total applied load
$y = x_o - x$ = in., vertical deflection
E = psi, modulus of elasticity
I = in.$^4$, moment of inertia of the beam Subscripts $h$ and $l$ denote the high and low load conditions, respectively.

The force acting on the beam body can be expressed by $f = \pi/4\ d^2\ \Delta P$.

Also, the force can be expressed in terms of beam stiffness and deflection, i.e., $f = Ky - K(x_o - x)$. Hence, $\pi/4\ d^2\ \Delta P = K(x_o - x)$ or $$\Delta P = \frac{4}{\pi}\ \frac{K}{d^2}(x_o - x) = m(x_o - x) \qquad (1)$$

where $$m = \frac{4}{\pi}\ \frac{K}{d^2}$$

From Eq. (1) it may be seen that the valve opening is related to the pressure drop across the valve. This relationship is also graphically illustrated by the straight line valve characteristic line 66 in FIG. 10.

Figure 10:
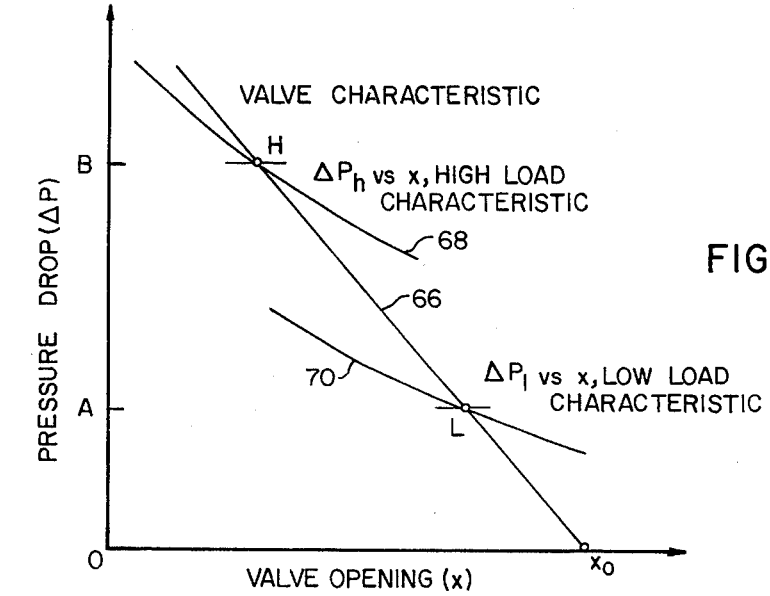
FIG. 10 is a graphical representation illustrating the general relationship between pressure drop and valve opening for a typical air conditioner for purposes of explaining the design example.

Line 68 of FIG. 10 illustrates a typical shape of a curve of values of pressure drop versus valve opening that can be obtained by adjusting the valve opening of a manually adjustable expansion valve of an air conditioner operated under a high load condition while measuring the corresponding pressure drop. Line 70 of FIG. 10 illustrates a typical shape of a curve for operation under a low load condition.

The valve designer has control over the slope and the x intercept of the valve characteristic. Therefore, as illustrated in FIG. 10, it is theoretically possible to design the valve to satisfy any high load and low load pressure drop requirements (i.e., by operation at points H and L) so long as these requirements are consistent with other constraints of the valve design.

Although the above discussion has been based upon meeting specified high load and low load operating points, by design the valve can as well meet specified high load and rated load, or low load and rated load points. Since there are only two independent design parameters, the slope and the intercept, the design cannot generally meet independently specified high load, rated load, and low load operating pressure drops. However, from a practical point of view it is not necessary to meet three independent conditions.

The following paragraphs give a numerical example of how to design a valve to meet high and low load conditions for a specific room air conditioner charged with R-22 refrigerant and having a nominal 15000 BTU per hour rating. The values set forth in the table below are those measured and calculated from the operation of such an air conditioner provided with a conventional automatic expansion valve.

| | Low Load Conditions | Rating Conditions | High Load Conditions |
|---|---|---|---|
| Pressure Drop P(psi) | 142 | 253 | 322 |
| Flow Rate (lb/hr) | 203 | 209 | 224 |
| Density before Valve (slug/ft³) | 2.225 | 2.190 | 2.145 |
| Flow Rate (cfs) | $7.90\times10^{-4}$ | $8.24\times10^{-4}$ | $9.05\times10^{-4}$ |

From the standard orifice equation, the effective expansion orifice area, A is found for high and low load conditions, as follows:

$$A_h = \frac{Q}{C_d\sqrt{\frac{2\Delta P_h}{\rho Ph}}} = \frac{9.05\times10^{-4}}{0.611\sqrt{\frac{2\times322\times144}{2.145}}} = 7.12\times10^{-6}\ \text{ft}^2 = 0.00103\ \text{in}^2 \quad (2)$$

$$A_l = \frac{Q_l}{C_d\sqrt{\frac{2\Delta P_l}{\rho l}}} = \frac{7.9\times10^{-4}}{0.611\sqrt{\frac{2\times142\times144}{2.225}}} = 9.55\times10^{-6}\ \text{ft}^2 = 0.00137\ \text{in}^2 \quad (3)$$

where $C_d = 0.611$ is obtained from FIG. 85 of the reference book of H. Rouse entitled "Elementary Mechanics of Fluids", published by John Wiley and Sons, 1960.

A proper outlet diameter, d, is chosen to get reasonable values of $x$ for high and low load conditions.

$$x_h = \frac{A}{\pi d},\ x = \frac{A_l}{\pi d}$$

If the selected $d = 0.110$ inch, then $x_h = 0.00298$ inch, and $x_l = 0.00397$ inch.

The ratio of the area of outlet orifice $$\left(\frac{\pi}{4}d^2\right)$$

and the area of effective orifice ($\pi d x_l$) at low load conditions is $d/4x_l = 6.9$. This area ratio is large enough so that the annular opening is the principal restriction and controls the expansion.

Figure 11:
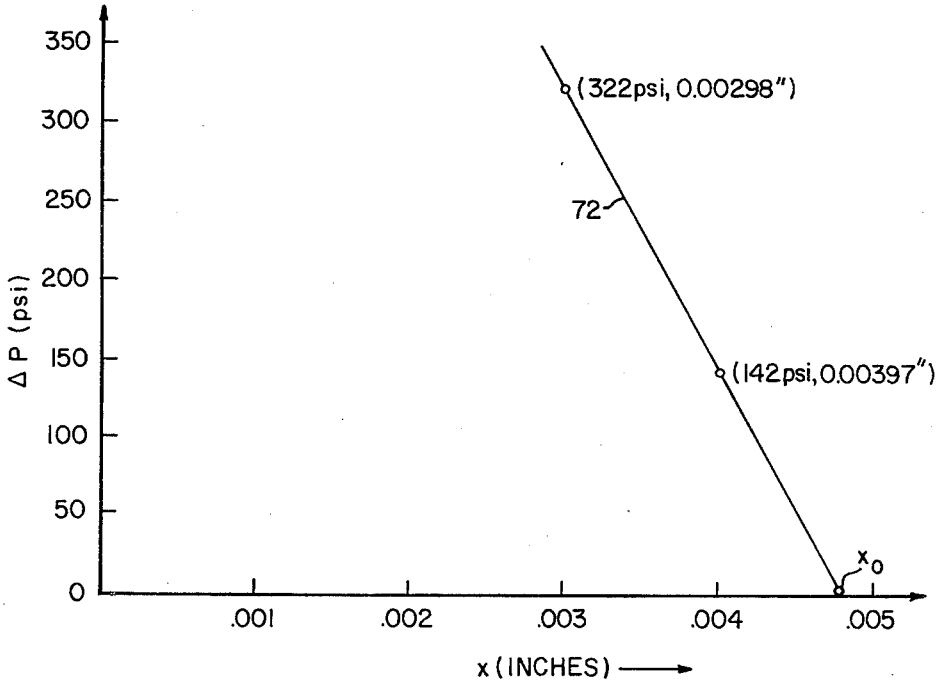
FIG. 11 is a graphical representation of pressure drop versus valve opening for the design example for a specific room air conditioner.

By plotting the high and low load operating points in a $\Delta P$ versus $x$ plane as shown in FIG. 11, a calculated or a graphical determination can be made of the $x_o$ intercept and $-m$ the slope, these determinations being $x_o = 0.0048$ inch and $-m = -1.82\times10^5$ No./in³, from line 72.

Then the required beam stiffness is calculated $$K = \frac{\pi d^2}{4}m = \frac{\pi}{4}(0.110)^2\times1.79\times10^5 = 1.73\times10^3\ \text{No./in.}$$

The deflection formula is then used to design the beam as follows: For a free support beam, the deflection formula is $$y = \frac{1}{48}\frac{Wl^3}{EI} \quad (4)$$

or $$K = \frac{W}{y} = \frac{48\,EI}{l^3} \quad (5)$$

Solving Eq. (5) for I yields $$I = \frac{Kl^3}{48E} \quad (6)$$

With a selected length of beam $l = 2.00$ inches, $E = 3.0\times10^7$ p.s.i. (a typical value for steel), then $$I = \frac{1}{12}bt^3 = \frac{Kl^3}{48E} = \frac{1.7^3\times10^3\times2.0^3}{48\times3.0\times10^7} = 9.56\times10^{-6}\ \text{in}^2$$

If a beam thickness value ($b$) of 0.0598 inch is selected then the beam width ($b$) is calculated from Equation 7 to be 0.538 inch.

Figure 5:
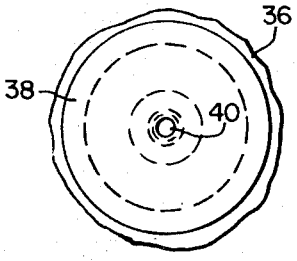
FIG. 5 is a sectional view corresponding to one taken along the line V—V of FIG. 4.

The design procedure for a valve of the type shown in FIGS. 4 and 5 (the Putman-Thompson variation) would be generally the same, with the difference being that the beam deflection would be based upon the deflection of the disc 38, and the forces being determined from the differential pressure upon the opposite exposed faces of the disc.

It is within the contemplation of the present invention that the beam take other forms than that of a simple beam. Thus the beam could take the form of a circular disc in which sufficiently large openings are provided therein and spaced away from the central area of the disc that there is no significant pressure drop of the liquid refrigerant passing through the holes, and with the annular expansion orifice still being provided between the upstream end of a nozzle and the facing solid area of the undersurface of the disc beam.

Experimental operation of the beam type valve of this invention shows that it compares favorably with the conventional automatic expansion valve in performing the throttling function at low, rated and high load conditions. Since it does not respond to evaporator pressure increases alone, and is open during off periods of compressor operation, it does not impose a limitation of waiting to restart the compressor until equalization of pressures occurs through a bleed port. Fan motor failures are avoided as a problem with this type of valve without any requirement of a pressure relief device. Finally, the simplicity of the construction, and the limited number of parts, should be apparent from the foregoing description.

I claim as my invention:

1. A mechanical refrigeration air conditioning system including:

a refrigeration compressor;

a refrigeration condenser operating at varying relatively higher pressures in normal operation;

a refrigerant evaporator operating at varying relatively lower pressures in normal operation;

a refrigeration expansion valve connected to receive substantially liquid refrigerant from said condenser and to discharge substantially expanded vaporous refrigerant to said evaporator, said valve having a deflectable member and stationary structure spaced therefrom to define a variable size refrigerant expansion orifice therebetween, the face areas of said member upstream from said orifice being exposed to the pressure of said liquid refrigerant, and the face areas of said member downstream from said orifice being exposed to the pressure of said vaporous refrigerant, the transverse area of said orifice, the stiffness of said deflectable member, and the distance between said member and said stationary structure being related to the range of differential pressures encountered in normal operation of the system to provide on the average increasing and decreasing refrigerant flow rates with increasing and decreasing differential pressures, respectively, of said liquid and vaporous refrigerant.

2. A mechanical refrigeration air conditioning system as defined in claim 1, wherein said expansion valve comprises: a valve body having an inlet thereto connected to receive the refrigerant from said condensor and an outlet therefrom connected to discharge the substantially expanded vaporous refrigerant to said evaporator; said body containing said deflectable member and said stationary structure.

3. A mechanical refrigeration air conditioning system as defined in claim 2, wherein said deflectable member comprises a free support beam mounted in said valve body and said stationary structure being closely spaced from said beam and comprises a rim of the inlet end for said outlet from said body; so that all of the face area of said beam in said chamber except for that face area directly facing said rim, is subject to the pressure of said liquid refrigerant, while said face area directly facing said rim is subject to the pressure of said expanded vaporous refrigerant.

4. A system as defined in claim 3, wherein said expansion valve includes supplementary means extending between said valve body and said beam for damping flow-induced vibrations of said beam.

5. A system as defined in claim 2, wherein said expansion valve deflectable member is a beam, cantilever supported within said body at one end.

6. A system as defined in claim 5, wherein said expansion valve closely spaced structure comprises a rim of the inlet end for said outlet from said body; and said rim and cantilever support for said beam are supported from common structure in said valve body to promote the maitenance of proper spacing between said rim and beam maintenance changes in differential pressure tending to effect deformation of said valve body.

7. A system as defined in claim 5, wherein: supplementary means extend between said valve body and said beam for damping flow-induced vibrations of said beam.

8. A system as defined in claim 2, wherein said stationary structure is located a distance from said deflectable member predetermined such that with selected degrees of flexure of said member in accordance with the selected forces imposed upon said member, said member assumes a position giving substantially predetermined valve openings at two of three load conditions of the system including the low, rated, and high load system conditions.

9. A system as defined in claim 2, wherein said stationary structure is spaced closely adjacent said deflectable portion and is in the form of a nozzle-shaped structure with the end of the nozzle defining said expansion orifice with the facing part of said deflectable portion.

10. A refrigerant expansion valve adapted to receive substantially liquid refrigerant from a refrigerant condenser and to discharge substantially expanded vaporous refrigerant to a refrigerant evaporator of a refrigerant system subject to changing loads, including: a hollow body valve body with an inlet and an outlet, a deflectable member therein, and stationary structure in said valve body spaced closely adjacent said deflectable member to define a refrigerant expansion orifice between said deflectable member and said structure; flow passage means defined in said valve body for subjecting at least one face of said deflectable member to the pressure of said liquid refrigerant upstream from said expansion orifice, and for subjecting at least part of the opposite face of said deflectable member to the pressure of said expanded vaporous refrigerant downstream from said expansion orifice to provide for increased and decreased refrigerant flow rate on the average with increases and decreases in differential pressure, respectively, with the differential pressure encountered in normal operation between a low load and a high load condition; said hollow body comprising: a spool-shaped member having said inlet at one end and said outlet at the other end, the mid-portion of said spool-shaped member being removed at one side to provide a recess including a first support portion for said stationary structure and a second support portion for said deflectable member, a first fluid communication means from said first support portion to said outlet and a second fluid communication means from said recess to said inlet; a sleeve coaxially, slidably disposed over said spool-shaped member; and seal means sealing both ends of said spool-shaped member with said sleeve.

* * * * *

UNITED STATES PATENT OFFICE

CERTIFICATE OF CORRECTION

Patent No. 3,952,535 Dated April 27, 1976

Inventor(s) Thomas H. Putman

It is certified that error appears in the above-identified patent and that said Letters Patent are hereby corrected as shown below:

In Column 8, at approximately lines 30 and 35, the (2) and (3) refer to the respective formulas which appear lateral thereof in column 7.

Column 7, between lines 45 and 50, change the formula "$x_h = \frac{A}{\pi d}$, $x = \frac{A\ell}{\pi d}$" to read: --$x_h = \frac{A_h}{\pi d}$, $x = \frac{A\ell}{\pi d}$--.

Column 7, line 66 change "$-m = -1.82 \times 10^5$ No/in$^3$," to read: -- $-m = -1.82 \times 10^5$ #/in$^3$, --.

Column 8, line 1, change:

"$K = \frac{\pi d^2}{4} m = \frac{\pi}{4} (0.110)^2 \times 1.79 \times 10^5 = 1.73 \times 10^3$ No/in."

to read:

-- $K = \frac{\pi d^2}{4} m = \frac{\pi}{4} (0.110)^2 \times 1.79 \times 10^5 = 1.73 \times 10^3$ #/in. --

Column 8, line 42, change "(b)" to --(t)--.

Column 10, claim 6, line 6, change "maitenance" to --maintenance--

Column 10, claim 6, line 7, delete "maintenance", after beam and insert --during--.

Signed and Sealed this

Thirty-first Day of August 1976

[SEAL]

*Attest:*

RUTH C. MASON
*Attesting Officer*

C. MARSHALL DANN
*Commissioner of Patents and Trademarks*